US005332472A

United States Patent [19]

Cutright et al.

[11] Patent Number: 5,332,472

[45] Date of Patent: Jul. 26, 1994

[54] APPLICATION OF FLUIDIZED MATERIAL TO A SUBSTRATE USING DISPLACEMENT TRANSFER

[75] Inventors: Edwin L. Cutright, Powhatan; G. Robert Scott, Midlothian; Howard W. Vogt, Jr., Providence Forge, all of Va.

[73] Assignee: Philip Morris Incorporated, New York, N.Y.

[21] Appl. No.: 983,378

[22] Filed: Nov. 30, 1992

[51] Int. Cl.[5] ..... D21H 23/02; D21H 25/00

[52] U.S. Cl. ..... 162/139; 162/186; 162/109; 162/135; 118/211; 118/262; 118/264; 427/210; 427/286; 427/428

[58] Field of Search ..... 162/123, 109, 117, 132, 162/133, 320, 186, 135; 101/153; 118/212, 406, 211, 204, 262, 263, 264; 131/364; 427/210, 286, 428

[56] References Cited

U.S. PATENT DOCUMENTS

| | | | |
|---|---|---|---|
| 1,393,637 | 10/1921 | Ohashi . | |
| 2,056,273 | 10/1936 | Holdsworth | 91/18 |
| 2,531,036 | 11/1950 | Goettsch | 91/12 |
| 2,553,592 | 5/1951 | Kucklinsky | 91/49 |
| 2,698,574 | 1/1955 | Dougherty et al. | 101/120 |
| 3,107,181 | 10/1963 | Bauder | 118/211 |
| 3,919,973 | 11/1975 | Zimmer | 118/406 |
| 3,965,817 | 6/1976 | Ipek | 101/120 |
| 3,988,986 | 11/1976 | Zimmer | 101/119 |

*Primary Examiner*—W. Gary Jones
*Assistant Examiner*—Brenda Lamb
*Attorney, Agent, or Firm*—Kevin B. Osborne; James E. Schardt; Charles E. B. Glenn

[57] ABSTRACT

This invention relates to the treatment of substrates with fluidized material in repetitive patterns during application cycles. The treatment patterns made with this invention can be altered by changing machine operating parameters. The patterns of fluidized material are applied to substrates using an applicator drum. Machined in the outer surface of the applicator drum are a plurality of slots filled with deformable material. The deformable material extends to a position in each slot just short of the outside diameter of the applicator drum, leaving a cavity in each slot. These cavities are filled with slurry in a slurry applicator unit. A compression drum mounted within the hollow interior of the applicator drum uses compression tips to displace the deformable material in each slot in succession beyond the periphery of applicator drum at a position adjacent to the substrate, causing the slurry in the cavity to be applied to the substrate.

42 Claims, 5 Drawing Sheets

APPLICATION OF FLUIDIZED MATERIAL TO A SUBSTRATE USING DISPLACEMENT TRANSFER

BACKGROUND OF THE INVENTION

This invention relates to a method and apparatus for treating paper with other material in repetitive patterns. More particularly, the invention relates to a method and apparatus whereby repetitive treatment patterns are created by a displacement transfer apparatus.

Methods for altering or enhancing the characteristics of paper are well known in the papermaking art. For example, many techniques have been developed for imprinting or coating paper webs. These include gravure presses, blade coating, roller coating, silkscreening and stenciling methods. Bogardy U.S. Pat. No. 4,968,534 describes a stenciling apparatus wherein a continuous stencil comes into facing engagement with a paper web during the application procedure. The apparatus includes a preparation step where air is evacuated from the web through the pattern stencil prior to the application step in order to facilitate the treatment procedure. The pattern applied by the device can be altered by changing the stencil used.

The apparatus of Bogardy U.S. Pat. No. 4,968,534 is typical of many of the other previously known treatment devices because the apparatus contacts the paper web during the application process. These previously known devices, as a result, can only be used at points in the papermaking process where the paper is sufficiently stable to withstand the contact. This limits flexibility in placement of these devices, because the devices cannot be incorporated in a papermaking machine at relatively early stages of the papermaking process.

Stenciling and other previously known methods generally transfer a predetermined pattern to a treated article. The only way to change the pattern applied is to replace the pattern-forming element of the device. In other words, there is no easy way to alter the pattern by, for instance, merely changing operating parameters. This characteristic particularly limits the applicability of these devices in mass-production situations where it is desirable to apply several patterns to paper being produced.

A particular limitation of devices like that of Bogardy U.S. Pat. No. 4,968,534 is that a stenciling device incorporating a pattern for applying relatively-closely spaced bands of narrow width to cigarette paper would experience flexure of the stencil and resultant pattern nonuniformity when scaled to the size of a papermaking machine of the type used to make the paper.

Improved methods for altering the characteristics of paper which overcome these limitations are of particular interest to cigarette manufacturers. Cigarette manufacturers have long appreciated the usefulness of adding flavorings or burn control additives to paper. More recently, it has been recognized that cigarette paper could be altered so that smoking articles incorporating the altered paper will have a reduced burn rate when the smoking article is not drawn on by a smoker.

Paper cigarette wrappers have burn characteristics, including burn rates and static burn capabilities. It is known that burn characteristics can be modified by adding fillers, coatings, or other additives to papers. Copending, commonly-assigned U.S. patent application Ser. No. 07/614,620, filed Nov. 16, 1990, which is hereby incorporated by reference in its entirety, includes a description of many of these methods, and also discloses a nonlaminated paper of variable basis weight and suggests that burn rate control of that paper can be achieved economically with mass-production techniques. The variable basis weight is achieved by applying bands of cellulosic slurry in a pattern to a moving paper web during production while leaving regions of the paper between the pattern untreated. The basis weight of the paper is increased in regions where the slurry has been applied, and when the paper is incorporated in a smoking article, the smoking article has a decreased burn rate in those regions. Limitations of previously known mass-production application methods like that disclosed in Bogardy U.S. Pat. No. 4,968,534 render them less effective for altering the basis weight of cigarette paper in patterns as described in above-incorporated U.S. patent application Ser. No. 07/614,620.

It would be desirable to provide a durable apparatus which can be inexpensively manufactured and easily incorporated into a papermaking machine at various points in the papermaking process.

It would be desirable to provide a method for treating a paper web where the pattern applied to the web can be changed by altering machine operating parameters.

It would be desirable to provide an application method in which a large quantity of web is treated with material in uniform patterns, in a continuous manner, and at high speeds.

It would be desirable to provide an application method where the amount of material applied can be accurately metered.

It would be desirable to provide an application method and apparatus for applying chemical treatments to cigarette paper so that burn rate control can be achieved economically with mass production techniques.

SUMMARY OF THE INVENTION

Accordingly, it is an object of the present invention to provide a durable apparatus which can be inexpensively manufactured and easily incorporated into a papermaking machine at various points in the papermaking process.

Another object of the present invention is to provide a method for treating a paper web where the pattern applied to the web can be changed by altering machine operating parameters.

Another object of the present invention is to provide an application method in which a large quantity of web is treated with material in uniform patterns, in a continuous manner, and at high speeds.

Another object of the present invention is to provide an application method where the amount of material applied can be accurately metered.

Another object of the present invention is to provide an application method and apparatus for applying chemical treatments to cigarette paper so that burn rate control can be achieved economically with mass production techniques.

The invention comprises an apparatus and method for applying fluidized material to paper in repetitive patterns to alter characteristics of the paper. As used herein, "fluidized material" means a substantially solid material suspended in a liquid—e.g., as a slurry—or dissolved in solution. Although in the preferred embodiment described below the invention is used for producing paper with variable burn rate characteristics, the invention could be used to apply many different fluidized materials to achieve differing paper characteristics. For instance, the invention could be used to apply compounds which are detectable by electromagnetic means for use in, e.g., security applications. The invention could also be used to apply dyes, inks or flavorings.

In a first preferred embodiment, the apparatus of this invention, a displacement transfer applicator, is mounted on a papermaking machine directly over the Fourdrinier wire between the wet line and the couch roll. The displacement transfer applicator includes a hollow applicator drum, which has a plurality of slots machined in its outer periphery parallel to the axis of the applicator drum. The slots, which penetrate through to the hollow interior of the drum, are partially filled with a deformable material so that a cavity remains between the outer surface of the deformable material and the outside diameter of the drum. The drum is rotated through a slurry reservoir where the cavities in the slots are filled with slurry. Immediately prior to leaving the slurry reservoir a doctor blade scrapes the outside diameter of the drum leaving an accurately metered amount of slurry in each cavity.

A compression drum is mounted eccentrically within the hollow interior of the applicator drum. The compression drum has a plurality of compression tips mounted on its outer surface extending parallel to its axis. Rotation of the compression drum causes each compression tip in succession to rotate into an associated slot impinging the inner surface of the deformable material in the slot at a position where the slot is adjacent to the paper web. The compression tip temporarily displaces the deformable material thereby forcing the slurry out of the slot and onto the moving paper web adjacent to the applicator drum. Each slot in succession causes a series of rectangular treated regions to be applied to the advancing paper web, creating regions of altered basis weight.

In a second preferred embodiment slots in the applicator drum and compression tips on the compression drum are spaced in a pattern of varying spacings, which cause slurry to be applied to the paper web in a pattern of varying spacings.

In a third preferred embodiment of the invention, the displacement transfer applicator is incorporated in a machine to treat finished, dry paper. This alternate embodiment includes a drying means to facilitate the drying of slurry bands applied to the web.

BRIEF DESCRIPTION OF THE DRAWINGS

The above and other objects and advantages of this invention will be apparent upon consideration of the following detailed description, taken in conjunction with the accompanying drawings, in which like reference characters refer to like parts throughout, and in which.

DETAILED DESCRIPTION OF THE INVENTION

Figure 1:
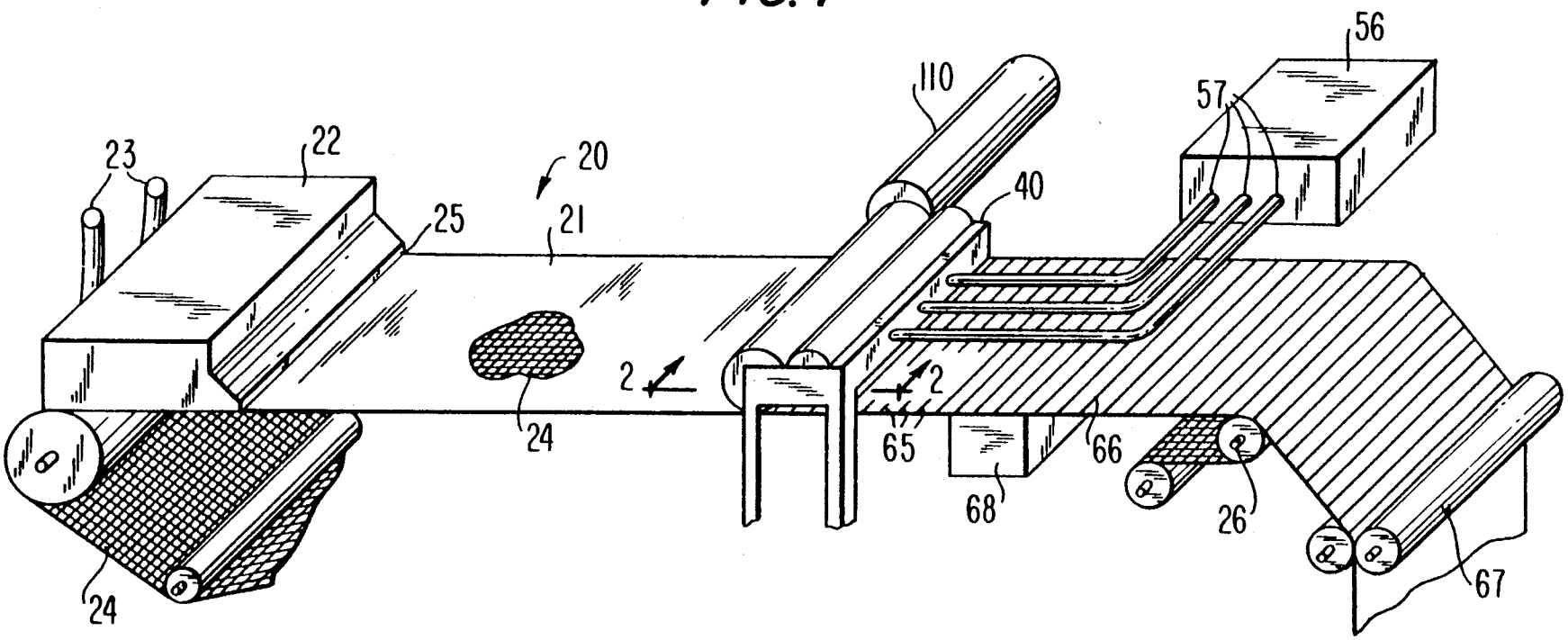
FIG. 1 is a perspective view of a papermaking machine incorporating a first preferred embodiment of the present invention.

The present invention relates to a method and apparatus for altering the characteristics of paper by treating the paper during or after the production process. With this invention many different paper characteristics can be achieved. For example, materials that confer distinctive characteristics upon the paper, such as compounds which are detectable by electromagnetic means, could be applied in accordance with the invention. Inks or dyes could also be applied in accordance with the invention. The invention could also be used to apply a pattern of flavor generating material, or a pattern of electrically conductive, resistive or insulating material, for use in a flavor generating article such as that disclosed in commonly assigned U.S. Pat. No. 5,060,671. In addition, the invention could be used to treat substrates other than paper. Although the first preferred embodiment of the invention relates to treatment of cigarette paper, it will be apparent that the invention has many applications.

The first preferred embodiment of the invention is a method and apparatus for altering the basis weight of cigarette paper in select regions so that burn rate characteristics are altered in those regions. As used herein, "base web" refers to untreated regions of paper and "treated regions" are regions of increased basis weight which are created in the base web by applying slurry in an application pattern.

An increase in basis weight of localized regions in a paper web may be achieved by increasing either the thickness, the density, or both in those regions. The increase in basis weight may be accomplished by depositing, onto an existing pulp web in a papermaking machine, additional fluidized material such as a second quantity of cellulosic pulp, or, alternatively, a filler material. As used herein "fluidized material" means a substantially solid material suspended in a liquid—e.g., as a slurry—or dissolved in solution. Some examples of additional materials are highly refined cellulosic pulp, high surface area cellulosic fibers such as cellulon, microcrystalline cellulose such as Avicel TM or a mixture of highly refined pulp and calcium carbonate. Other insoluble, cellulose-compatible materials could also be used, such as amylopectin.

The treated regions made in accordance with this invention have a basis weight above that of the base web. When paper made with the present invention is incorporated in a smoking article as the wrapper, the smoking article will have variable burn rate characteristics. For example, the static burn rate of the smoking article may be substantially decreased during combustion of treated regions, because regions of increased basis weight have decreased porosity. The rate of oxygen diffusion through the paper in these regions is thereby decreased, retarding combustion of the smoking article.

The dimensions of the treated regions may also affect the burn characteristics of the paper and, consequently, a smoking article incorporating the paper. When the paper is incorporated in a cigarette, the treated regions form a series of rings of known width and separation along the longitudinal axis of the cigarette. Both the width of and degree of separation between these rings of treated paper have a substantial effect on the overall burn rate of the smoking article. The width and degree of separation of the rings effectively determine what percentage of the smoking article will experience a burn rate decreased from the nominal rate associated with the base web.

The present invention provides a method and apparatus for applying slurry in any desired application pattern to form treated regions. The invention also allows the application pattern to be changed by adjustment of machine operating parameters, to alter, e.g., the size and the spacing of the treated regions of which the application pattern is comprised. This allows the same machine to make papers with differing variable burn rate characteristics.

A first preferred embodiment of the apparatus of this invention is shown in FIG. 1 which depicts the pulp web-forming area of a conventional Fourdrinier papermaking machine 20, adapted to produce a continuous pulp web 21. A headbox 22 contains a quantity of cellulosic pulp which is supplied to headbox 22 by a plurality of conduits 23 which communicate with a pulp source, such as a storage tank (not shown).

Placed immediately below headbox 22 is an endless forming wire 24. A slice 25 defined in a lower portion of headbox 22 adjacent to wire 24 permits pulp from headbox 22 to flow through slice 25 onto the top surface of wire 24 to form pulp web 21. Slice 25 is usually narrow in height in order to regulate the amount of pulp which flows from headbox 22. The length of slice 25 typically may extend substantially the entire width of pulp web 21.

The top portion of wire 24 is adapted to move forwardly toward a couch roll 26 and away from slice 25. The direction from headbox 22 toward couch roll 26 is the downstream direction. Once the pulp web has been formed, it passes under the apparatus of this invention, the displacement transfer applicator 40, which deposits additional material onto pulp web 21.

Figure 2:
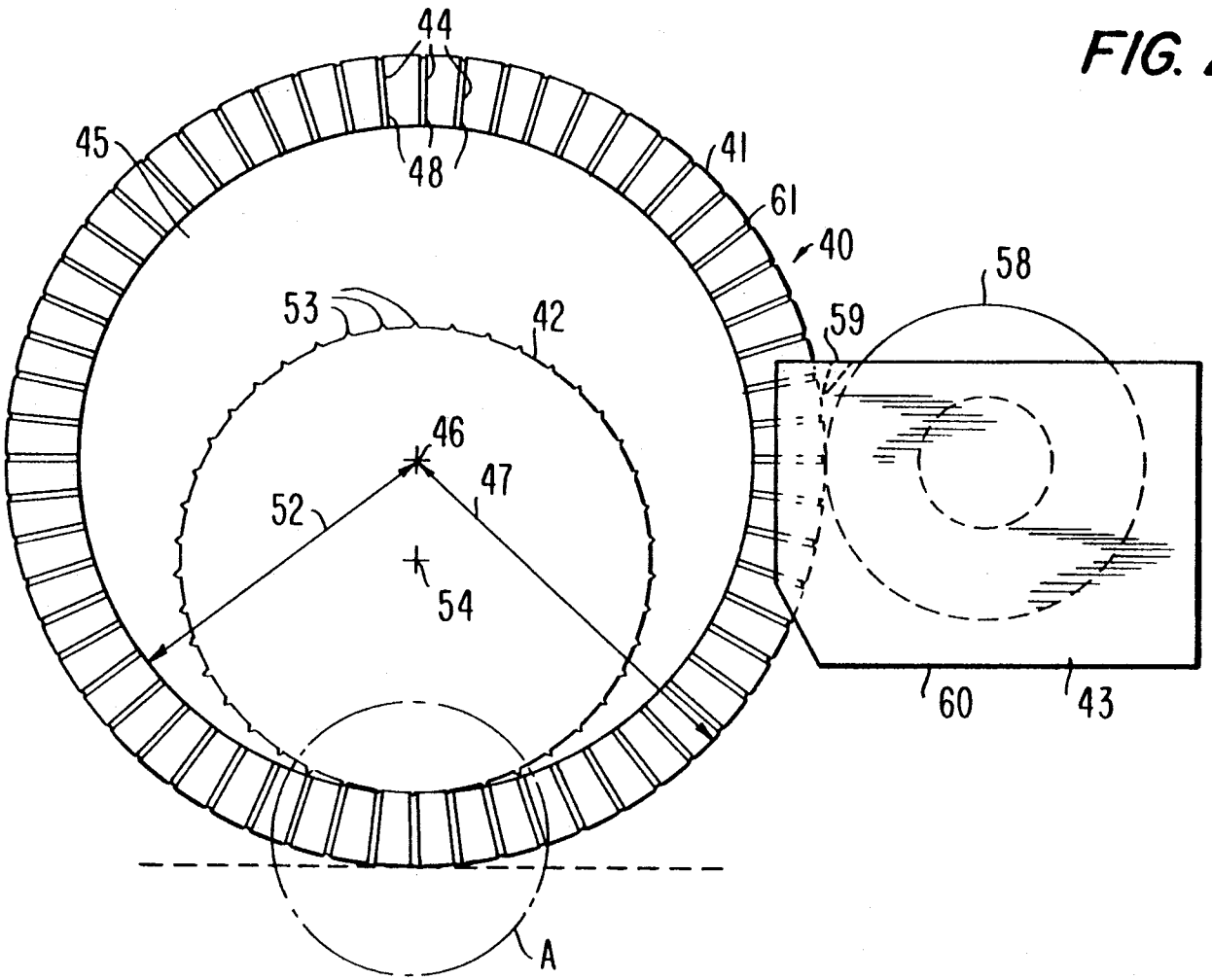
FIG. 2 is a vertical cross-sectional view of a displacement transfer applicator in accordance with the invention, taken along line 2—2 of FIG. 1.
Figure 3:
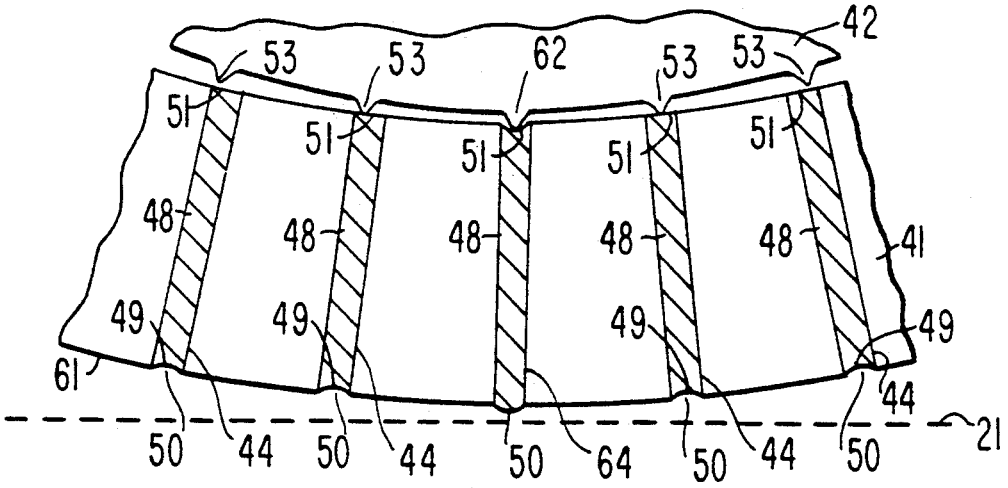
FIG. 3 is an enlarged view of area A of FIG. 2.

As shown in cross-sectional views FIGS. 2 and 3, the displacement transfer applicator includes an applicator drum 41, a compression drum 42, and a slurry application unit 43. The applicator drum 41 is cylindrical in shape and hollow and may be made from aluminum, steel or other suitable rigid materials. Machined into the surface of applicator drum 41 are a plurality of radial slots 44 which are in communication with the hollow interior 45 of the applicator drum 41, and which extend parallel to the axis 46 of the applicator drum 41. In FIG. 2, slots 44 are equiangularly spaced about the periphery of applicator drum 41. Slots 44 may also be arranged in a pattern of varying angular spacings.

Slots 44 are filled to a point within the outside diameter 47 of applicator drum 41 with deformable material 48. Deformable material 48 could be a number of conventional materials with minimal compression such as polyurethane. It is necessary that deformable material 48 have minimal compression so that it can be effectively displaced by contact to a point beyond the outside diameter 47 of applicator drum 41. Deformable material 48 is bonded to the prepared surfaces of slots 44 with conventional means. Cavities 49 remain above the outer surface 50 of deformable material 48 in each slot because the outer surface 50 of deformable material 48 is recessed from outside diameter 47 of applicator drum 41. The inner surfaces 51 of deformable material 48 in each slot 44 are substantially even with the inside diameter 52 of the applicator drum 41 and are left exposed.

Compression drum 42 is mounted eccentrically within applicator drum 41. Compression drum 42 has a plurality of compression tips 53 of substantially triangular cross-section that extend parallel to the axis 54 of compression drum 42. Compression drum 42 and compression tips 53 may be constructed of any suitable rigid material including steel and aluminum.

Applicator drum 41 and compression drum 42 are adapted for rotation at constant angular speed by conventional drive means 110 shown in FIG. 1, which may be any number of motors and drive trains familiar to those skilled in the art.

Mounted immediately next to applicator drum 41 is a slurry application unit 43. A slurry supply source 56 supplies slurry to slurry application unit 43 through a plurality of conduits 57. Slurry application unit 43 comprises a transfer roller 58, doctor blade 59 and slurry tank 60.

Slurry application cycles are initiated by rotation of applicator drum 41 through slurry application unit 43. Transfer roller 58 fills cavities 49 with slurry as applicator drum rotates through slurry application unit 43. Periphery 61 of applicator drum 41 is wiped clean by doctor blade 59, which leaves a metered amount of slurry in each cavity.

Continued rotation of applicator drum 41 brings each slot 44 in succession to a position immediately adjacent to pulp web 21, where that one compression tip 62 impinges the inner surface 51 of deformable material 48 in that one slot 64 immediately adjacent to pulp web 21. Angular velocities of applicator drum 41 and compression drum 42 are chosen so that a compression tip 53 will always impinge inner surface 51 of deformable material in that slot 64 which has reached a point immediately adjacent to web 21. Hence, it is possible that only a single compression tip 53 need be provided on compression drum 42, as long as compression drum 42 rotates quickly enough to cause a compression tip 53 to impinge deformable material 48 in every advancing slot 44.

That compression tip 62 which displaces the deformable material 48 in that one slot 64 immediately adjacent to pulp web 21 collapses the cavity 49 in that one slot 64 and forces the outer surface 50 of deformable material 48 to a position slightly beyond the outside diameter 47 of applicator drum 41. Slurry in that one cavity 64 forms a bead on the outer surface 50 of displaced deformable material 48 until deformable material 48 reaches a point where the bead contacts the pulp web 21, at which point the bead adheres to the pulp web 21, transferring the slurry to pulp web 21. The transferred slurry forms a treated region 65 on pulp web 21. After slurry has been applied to pulp web 21, that one compression tip 62 disengages from deformable material 48 in that one slot 64, allowing deformable material 48 to rebound to its former position. This allows a cavity 49 to reform in that one slot 64 in preparation for the next application cycle.

Referring again to FIG. 1, repeated application cycles cause a series of treated regions 65 to be applied to pulp web 21. These treated regions are substantially rectangular, corresponding to the shape and dimensions of slots 44 in applicator drum 41. These treated regions 65 are substantially parallel to one another and equally spaced and form the application pattern 66 which alters the characteristics of pulp web 21.

The intervals between treated regions 65 may also be varied by altering the angular velocities of applicator drum 41 and compression drum 42. Slowing the applicator drum 41 and compression drum 42, for instance, would result in treated regions 65 being farther apart, while accelerating the drums would result in treated regions 65 being closer together. Continually altering the angular velocity of the drums allows one to create a pattern of unequally spaced treated regions 65.

In the first preferred embodiment, the treated regions 65 are applied perpendicular to the direction of travel of pulp web 21. The treated regions 65 can also be applied at an oblique angle by pivoting displacement transfer applicator 40 in a plane parallel to the plane of the pulp web 21 so that that one slot 64 immediately adjacent to pulp web 21 is at an oblique angle to the direction of travel of pulp web 21.

Figure 4:
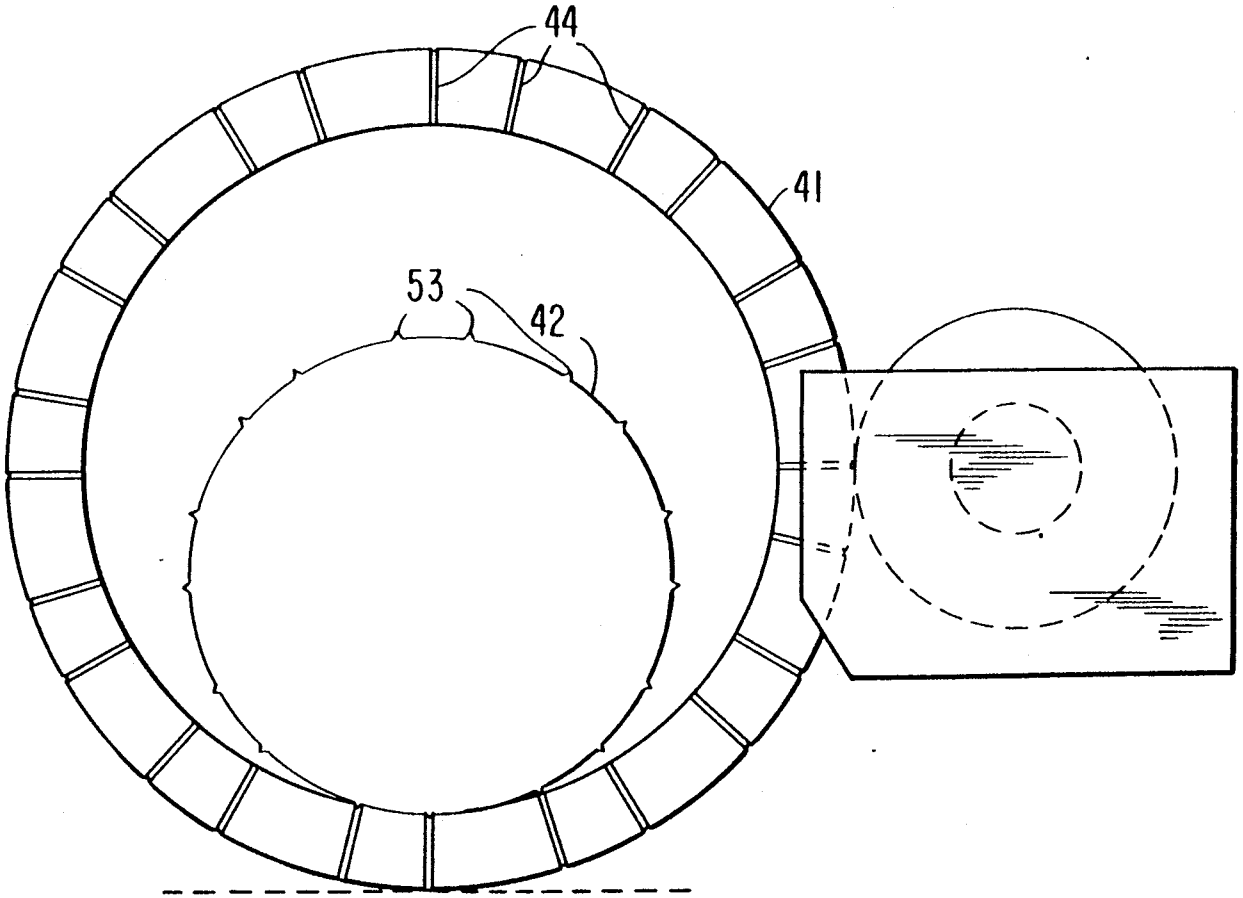
FIG. 4 is a vertical cross-sectional view of a second preferred embodiment of the invention.

In a second preferred embodiment, treated regions 65 may also be applied in a pattern of varying spacings by employing an applicator drum 41 and compression drum 42 where slots 44 and compression tips 53 are arranged in a pattern of varying spacings, as shown in FIG. 4. In this embodiment there is no need to vary operating speeds to achieve a pattern of varying spacings.

Other patterns may be applied with the displacement transfer applicator by constructing an applicator drum 41 having a different cross section in a plane parallel to pulp web 21. For instance, if slots 44 had circular cross sections in a plane parallel to the plane of pulp web 21, a series of circular regions of fluidized material could be applied to pulp web 21. This embodiment would require compression tips 53 with substantially conical cross sections.

After the displacement transfer applicator 40 has applied the application pattern 66 to the pulp web 21, the web continues to move in a downstream direction. As wire 24 begins to move downwardly about couch roll 26 and back toward headbox 22, pulp web 21 is delivered from wire 24 to a plurality of press rolls 67 and then to a conventional dryer section of papermaking machine (not shown). As pulp web 21 advances in the downstream direction, excess water is permitted to pass through wire 24. A vacuum 68 typically may be applied to at least a portion of the underside of wire 24 to assist in the removal of water from pulp web 21. Couch roll 26 may be adapted to provide a vacuum through wire 24 to the underside of pulp web 21 to remove additional water.

Figure 5:
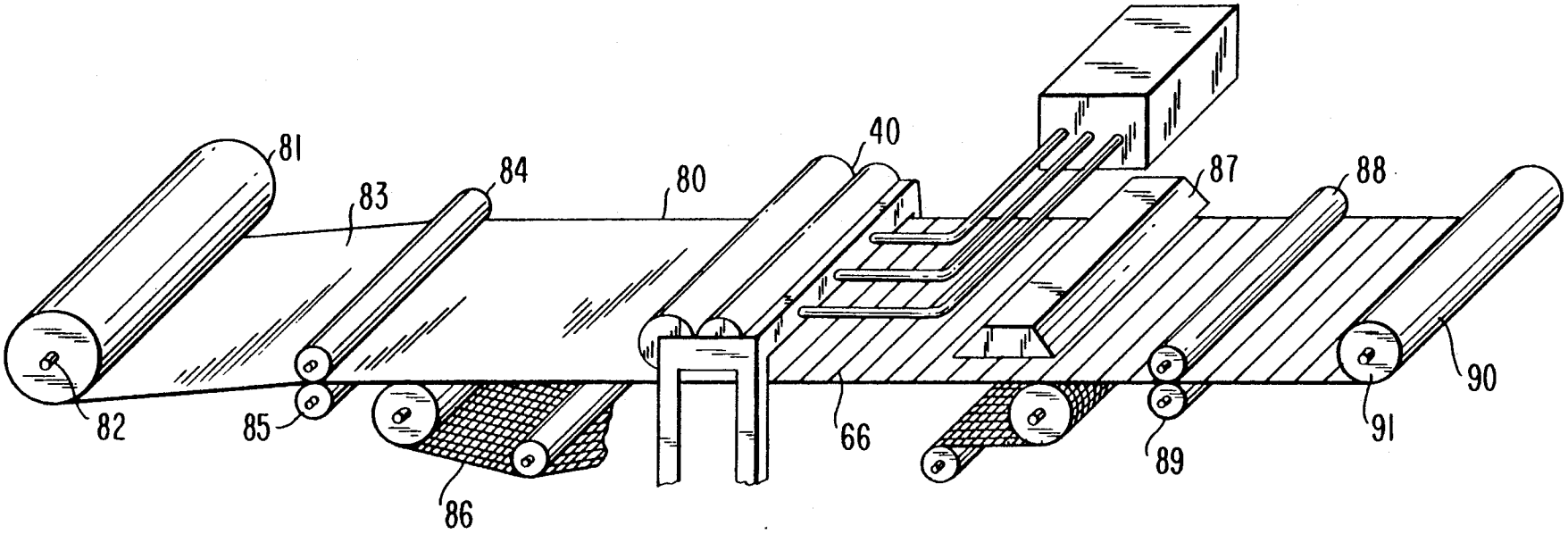
FIG. 5 is a perspective view of a third preferred embodiment of the invention.

In a third preferred embodiment of the invention, shown in FIG. 5, the displacement transfer applicator 40 has been incorporated in a machine 80 to treat premanufactured paper. The machine 80 has a roll of premanufactured paper 81 mounted on a feedshaft 82. The paper 83 on the roll 81 is fed between an upper idler 84 and a lower idler 85 and onto a continuous moving web 86. A continuous moving web may not be needed depending on paper strength. For example, the paper may be supported by a shoe (not shown) familiar to those skilled in the art. The displacement transfer applicator 40 is mounted above the continuous moving web 86 which is supporting the paper 83 to be treated. After the application pattern 66 has been applied to the paper 83 by the displacement transfer applicator 40, the paper moves underneath a dryer 87. A number of types of drying means familiar to those skilled in the art including felt absorption, heated drums and infrared drying may be used. After the application pattern 66 has been dried by the dryer 87, the paper moves between the final upper idler 88 and final lower idler 89. The paper 83 is taken up by a take-up roll 90 mounted on a take-up shaft 91.

Thus it is seen that an apparatus and method for treating paper in repetitive patterns where the repetitive patterns applied can be altered by changing apparatus operating parameters is provided. One skilled in the art will appreciate that the present invention can be practiced by other than the described embodiments, which are presented for purposes of illustration and not of limitation, and the present invention is limited only by the claims that follow.

We claim:

1. A method of applying a fluidized material to a substrate, said method comprising the steps of:

(a) moving said substrate along a path;

(b) introducing said fluidized material into a cavity located immediately adjacent to said substrate and formed by at least two materials, one of said materials being deformable and the other of said materials being rigid, said deformable material having an outer surface facing toward said substrate and an inner surface facing away from said substrate, said deformable material bonded to said rigid material, said cavity having a cavity surface, said outer surface of said deformable material forming at least a portion of said cavity surface, said fluidized material in contact with said outer surface of said deformable material; and (c) discharging said fluidized material in said cavity by momentarily impinging and forcing said inner surface of said deformable material toward said substrate, thereby temporarily collapsing said cavity and temporarily displacing said outer surface of said deformable material to a position where said fluidized material on said outer surface of said deformable material contacts said substrate and adheres to said substrate.

2. The method of claim 1, wherein said substrate comprises a web.

3. The method of claim 2, wherein said web comprises a paper web.

4. The method of claim 3, wherein said fluidized material comprises a slurry to alter burn rate characteristics of said paper web.

5. A method of applying a fluidized material to a web in a series of application cycles, said method comprising the steps of:

(a) moving said web along a path in a direction of travel;

(b) introducing said fluidized material between said application cycles into at least one cavity formed by at least two materials, one of said materials being deformable and the other of said materials being rigid, said deformable material having an outer surface and an inner surface, said deformable material bonded to said rigid material, said cavity having a cavity surface, said outer surface of said deformable material forming at least a portion of said cavity surface, said fluidized material in contact with said outer surface of said deformable material;

(c) moving said at least one cavity filled with said fluidized material to a point immediately adjacent to said web between said application cycles; and (d) discharging said fluidized material in said at least one cavity during said application cycles by momentarily impinging and forcing said inner surface of said deformable material towards said web at said point, said outer surface of said deformable material facing said web at said point, thereby temporarily collapsing said cavity and temporarily displacing said outer surface of said deformable material to a position where said fluidized material on said outer surface of said deformable material contacts said web and adheres to said web.

6. The method of claim 5, wherein said web comprises a paper web.

7. The method of claim 6, wherein said fluidized material comprises a slurry to alter burn rate characteristics of said paper web.

8. The method of claim 5, wherein said fluidized material is discharged onto said web in an application pattern comprising a series of treated regions.

9. The method of claim 8, wherein said treated regions are substantially rectangular and substantially parallel to one another.

10. The method of claim 9, wherein said treated regions are perpendicular to said direction of travel of said web.

11. The method of claim 9, wherein said treated regions are at an oblique angle to said direction of travel of said web.

12. The method of claim 5, wherein said application cycles occur at equal time intervals and said web moves at constant velocity whereby said fluidized material is applied at equally spaced intervals along said web.

13. The method of claim 12, wherein the linear measure of said equally spaced intervals can be varied by changing the duration of said equal time intervals to a new value.

14. The method of claim 5, wherein said application cycles occur in a repetitive pattern of varying time intervals whereby said fluidized material is applied in a repetitive pattern of varying spacings along said web.

15. The method of claim 5, further comprising the step of applying a vacuum to said web after said fluidized material has been applied to said web.

16. The method of claim 5, further comprising the step of drying said web after said fluidized material has been applied to said web.

17. An apparatus for applying a fluidized material to a substrate, comprising:

means for moving said substrate along a path;

applicator means, said applicator means having a cavity for holding said fluidized material adjacent to said substrate, said cavity formed by at least two materials, one of said materials being deformable and the other of said materials being rigid, said deformable material having an outer surface facing toward said substrate and an inner surface facing away from said substrate, said deformable material bonded to said rigid material, said cavity having a cavity surface, said outer surface of said deformable material forming at least a portion of said cavity surface, said fluidized material in contact with said outer surface of said deformable material;

supply means for providing said applicator means with said fluidized material; and displacement means for momentarily impinging and forcing said inner surface of said deformable material towards said substrate, thereby temporarily collapsing said cavity and temporarily displacing said outer surface of said material to a position where said fluidized material on said outer surface of said deformable material contacts said substrate and adheres to said substrate.

18. The apparatus of claim 17, wherein said substrate comprises a web.

19. The apparatus of claim 18, wherein said web comprises a paper web.

20. The apparatus of claim 19, wherein said fluidized material comprises a slurry for altering burn rate characteristics of said paper web.

21. An apparatus for applying a fluidized material to a web in a series of application cycles, said apparatus comprising:

means for moving said web along a path in a direction of travel;

applicator means, said applicator means having at least one cavity formed by at least two materials, one of said materials being deformable and the other of said materials being rigid, said deformable material having an outer surface and an inner surface, said deformable material bonded to said rigid material, said at least one cavity having a cavity surface, said outer surface of said deformable material forming at least a portion of said cavity surface, said fluidized material in contact with said outer surface of said deformable material;

supply means for replenishing said at least one cavity in said applicator means with said fluidized material between said application cycles;

movement means for moving said at least one cavity in said applicator means to a point immediately adjacent to said web; and displacement means for momentarily impinging and forcing said inner surface of said deformable material towards said web at said point during each of said application cycles, said outer surface of said deformable material facing said web at said point, thereby temporarily collapsing said cavity and temporarily displacing said outer surface of said deformable material to a position where said fluidized material on said outer surface of said deformable material contacts said web and adheres to said web.

22. The apparatus of claim 21, wherein said web comprises a paper web.

23. The apparatus of claim 22, wherein said fluidized material comprises a slurry to alter burn rate characteristics of said paper web.

24. The apparatus of claim 21, wherein said fluidized material applied to said web during each of said application cycles forms an application pattern comprising a series of treated regions.

25. The apparatus of claim 24, wherein said at least one cavity is rectangular in cross section in a plane parallel to a plane of said web when said cavity is at said point, whereby said treated regions formed on said web during said application cycles are substantially rectangular and substantially parallel to one another.

26. The apparatus of claim 25, wherein said at least one cavity is oriented at an angle perpendicular to said direction of travel of said web at said point during each of said application cycles, whereby said treated regions are perpendicular to said direction of travel of said web.

27. The apparatus of claim 25 wherein said at least one cavity is oriented at an oblique angle to said direction of travel of said web at said point during each of said application cycles, whereby said treated regions are at an oblique angle to said direction of travel to said web.

28. The apparatus of claim 21, wherein said application cycles occur at equal time intervals whereby said fluidized material is applied at equally spaced intervals along said web.

29. The apparatus of claim 28 wherein the linear measure of said equally spaced intervals can be varied by changing the duration of said equal time intervals to a new value.

30. The apparatus of claim 21, wherein said application cycles occur in a repetitive pattern of varying time intervals, whereby said fluidized material is applied in a repetitive pattern of varying spacings along said web.

31. A displacement transfer applicator for applying a fluidized material to a web moving in a direction of travel during a series of application cycles, said displacement transfer applicator comprising:

an application drum located above said web, said application drum having a circumferential periphery, axis, inner diameter, outer diameter and a hollow interior, said application drum having at least one slot machined in said circumferential periphery, said at least one slot in communication with said hollow interior and extending parallel to said axis of said application drum, said application drum adapted for rotation; wherein:

said at least one slot is filled with deformable material from said inner diameter to just inside said outside diameter, said deformable material having an inner surface facing toward said hollow interior and an outer surface facing away from said hollow interior, said at least one slot having a cavity located between said outer surface of said deformable material and said circumferential periphery of said application drum; said displacement transfer applicator further comprising:

a compression drum mounted eccentrically within said hollow interior of said application drum, said compression drum having a circumferential periphery and axis, said compression drum having at least one compression tip extending outwards from said circumferential periphery and parallel to said axis of said compression drum, said compression drum adapted for rotation;

fluidized material application means, said fluidized material application means located adjacent to said application drum, said fluidized material application means filling said cavity with said fluidized material between each of said application cycles; and driving means for rotating said application drum and said compression drum whereby said compression tip impinges said inner surface of said deformable material in said at least one slot in said application drum at a point where said slot is immediately adjacent to said web, said compression tip temporarily collapsing said cavity and temporarily displacing said outer surface of said deformable material to a position beyond said outer diameter of said application drum where said fluidized material on said outer surface of said deformable material contacts said web and adheres to said web.

32. The displacement transfer applicator of claim 31, wherein said fluidized material application means comprises:

a fluidized material tank for holding said fluidized material, said fluidized material tank located adjacent to said application drum, said fluidized material tank having an opening adjacent to said application drum, a portion of said circumferential periphery of said application drum extending into said opening, said fluidized material tank and said portion of said application drum in sealing engagement preventing said fluidized material from escaping;

a transfer roller mounted in said fluidized material tank, said transfer roller having an axis parallel to said axis of said application drum, said transfer roller adapted for rotation, said transfer roller in tangential engagement with said portion of said application drum, said transfer roller dipping into said fluidized material, said transfer roller filling said cavity with said fluidized material as said at least one slot rotates through said fluidized material tank between said application cycles; and a doctor blade mounted on said fluidized material tank for wiping said portion of said circumferential periphery of said application drum clean immediately prior to said portion exiting said fluidized material tank, said doctor blade leaving said fluidized material in said cavity.

33. The displacement transfer applicator of claim 31 wherein said web comprises a paper web.

34. The displacement transfer applicator of claim 33, wherein said fluidized material comprises a slurry to alter burn rate characteristics of said paper web.

35. The displacement transfer applicator of claim 31, wherein said fluidized material applied to said web during each of said application cycles forms an application pattern comprising a series of treated regions.

36. The displacement transfer applicator of claim 35, wherein when said cavity is located at a point immediately adjacent to said web said cavity has a rectangular cross section in a plane parallel to a plane of said web, whereby said treated regions formed on said web are substantially rectangular and substantially parallel to one another.

37. The displacement transfer applicator of claim 36, wherein said cavity is oriented at an angle perpendicular to said direction of travel of said web at said point during each of said application cycles, whereby said treated regions are perpendicular to said direction of travel of said web.

38. The displacement transfer applicator of claim 36, wherein said cavity is oriented at an oblique angle to said direction of travel of said web at said point during each of said application cycles, whereby said treated regions are at an oblique angle to said direction of travel of said web.

39. The displacement transfer applicator of claim 31 wherein said application drum and said compression drum rotate at constant angular velocities whereby said fluidized material is applied at equally spaced intervals along said web.

40. The displacement transfer applicator of claim 39 wherein the linear measure of said equally spaced intervals can be varied by changing said constant angular velocities of said application drum and said compression drum to new constant angular velocities.

41. The displacement transfer applicator of claim 31, wherein said at least one slot comprises a plurality of slots equally spaced about said circumferential periphery of said application drum, and said at least one compression tip comprises a plurality of compression tips equally spaced about said circumferential periphery of said compression drum.

42. The displacement transfer applicator of claim 31, wherein said at least one slot comprises a plurality of slots, said slots spaced in a repetitive pattern of angular spacings about said circumferential periphery of said application drum, and said at least one compression tip comprises a plurality of compression tips, said compression tips spaced in a repetive pattern of angular spacings about said circumferential periphery of said compression drum.

* * * * *